US008740220B2

(12) United States Patent
Hodgson et al.

(10) Patent No.: US 8,740,220 B2
(45) Date of Patent: Jun. 3, 2014

(54) METHOD OF AND MACHINE FOR PLAYING GAMBLING GAME WITH MULTIPLE WINNING THRESHOLDS

(75) Inventors: Lawrence Hodgson, Kildeer, IL (US); Leonid Smikun, Glenview, IL (US)

(73) Assignee: Incredible Technologies, Inc., Vernon Hills, IL (US)

( * ) Notice: Subject to any disclaimer, the term of this patent is extended or adjusted under 35 U.S.C. 154(b) by 160 days.

(21) Appl. No.: 13/280,711

(22) Filed: Oct. 25, 2011

(65) Prior Publication Data

US 2012/0112413 A1 May 10, 2012

Related U.S. Application Data

(60) Provisional application No. 61/410,973, filed on Nov. 8, 2010.

(51) Int. Cl.
*A63F 1/00* (2006.01)

(52) U.S. Cl.
USPC ..... 273/292; 463/13

(58) Field of Classification Search
USPC ..... 273/292; 463/13
See application file for complete search history.

(56) References Cited

U.S. PATENT DOCUMENTS

| | | | | |
|---|---|---|---|---|
| 6,206,373 | B1 * | 3/2001 | Garrod | 273/292 |
| 2006/0027968 | A1 * | 2/2006 | Snow | 273/292 |
| 2007/0080497 | A1 * | 4/2007 | Kenny et al. | 273/292 |

* cited by examiner

*Primary Examiner* — Michael Dennis
(74) *Attorney, Agent, or Firm* — Husch Blackwell LLP

(57) ABSTRACT

A method for playing a game wherein a positive outcome for a player requires both a superior ranking over other players or fixed outcomes, and an absolute minimum ranking, is disclosed. A machine incorporating the method described is also disclosed.

12 Claims, 5 Drawing Sheets

METHOD OF AND MACHINE FOR PLAYING GAMBLING GAME WITH MULTIPLE WINNING THRESHOLDS

BENEFIT CLAIM

This application claims the benefit of U.S. Provisional Application No. 61/410,973, filed Nov. 8, 2010.

OBJECTS OF THE INVENTION

An object of the invention is to provide a method for playing a game with multiple winning thresholds.

A second object of the invention is to provide a machine for playing a game with multiple winning thresholds.

A third object of the invention is to provide an entertaining variation on previously known games by introducing multiple winning thresholds.

Other objects and advantages of the invention will become apparent in the following disclosure.

SUMMARY OF THE INVENTION

The present invention relates to games which evaluate the outcome of the game based upon a fixed ranking of various outcomes, such as dice or poker. Instead of simply comparing a player or players outcome(s) to a fixed pay table, or ranking the outcomes of multiple players' hands against a statistically or subjectively determined preferred ranking, the present invention teaches a method of combining the combination of both types of outcome evaluation to provide a novel and interesting version of such a game. As the invention is particularly suitable for play on an electronic device, a device incorporating the method of play is also included in the present application.

BRIEF DESCRIPTION OF THE DRAWINGS

The characteristic features of the invention will be particularly pointed out in the claims. The descriptions of the preferred embodiment refer to the preceding drawings:

DESCRIPTION OF THE PREFERRED EMBODIMENT

Figure 1:
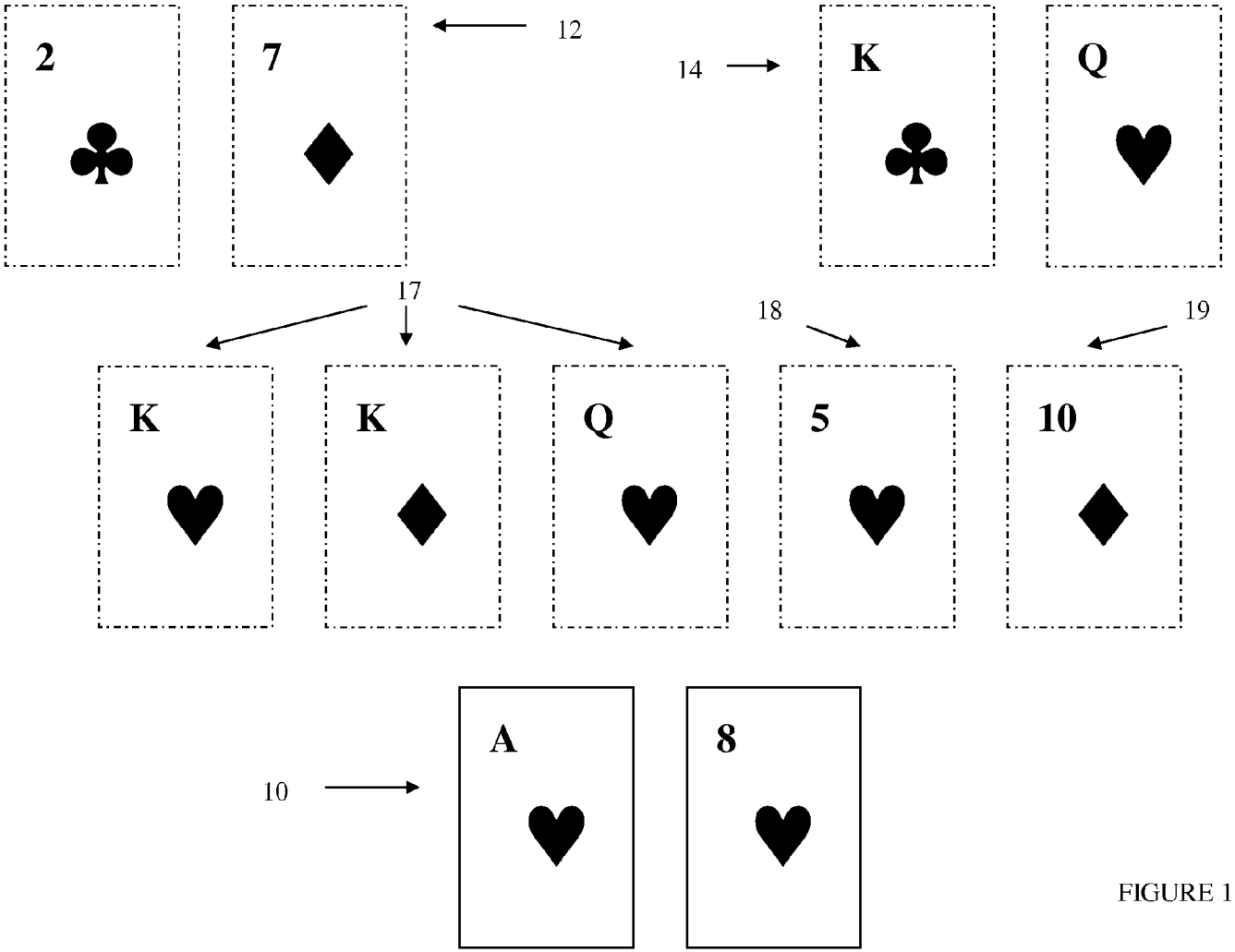
FIG. 1 is an initial configuration of standard playing cards dealt into multiple hands of the poker variation known as Hold 'Em.

The description of the preferred embodiment uses the invention as applied to the poker variant commonly known as "Hold 'Em" or "Texas Hold 'Em," as played with a standard 52-card deck. It could be used in any desired gaming or entertainment device, including but not limited to such things as a video poker game, a video keno game, a combination gaming machine, or even a coin-operated or bartop amusement device.

The description of the preferred embodiment further refers to the evaluation objects as "cards," since those are what are used to play Hold 'Em, and to the evaluation groupings as "hands" likewise. If the invention were applied to a dice game, the evaluation objects would be individual dice, hands would be groups of dice, and so forth. Wherever the term "cards" is used, it should be understood to mean "the appropriate individual evaluation objects," and the term "hand" or "hands" should be understood to mean, "the group of evaluation objects which cumulatively produce a rankable outcome." In some games this group might have only one member.

Before play begins, it is required to define a minimum ranking or score which will determine whether the player is entitled to collect any winnings at all. For purposes of the preferred embodiment, the minimum ranking will be considered a pair of Jacks or better, under the commonly understood laws of poker. If the player's hand meets or exceeds the minimum ranking, they are eligible to receive a payout. It does not, they are not so eligible. It is further required to assign a pay value—usually a multiple of the initial wager, but this is neither preferred nor required—to all rankings. For hands below the minimum ranking, this is zero, as is obvious. For hands equal to or above it, it may be constant, or related to the ranking of the hand. It is preferred that the values be assigned in such a way that over a statistically significant number of games, the player will tend to get enough zero-value hands to more than negate the value of all positive-value hands. If this is not done, the House (defined below) will lose money and the game will not be sustainable. It is also preferred that the value of a hand be statistically related to and increase with the rarity of a hand, as this makes the game more exciting and allows for larger values at the extremes of the possible number of outcomes while allowing small values to be assigned to more common hands, which reduces the number of zero-value hands which produce a loss for the player.

It is required that there be at least one "player," who is an independent entity making at least one wager, ante, or other form of bet, and at least one "House," the House being the entity which retains the player's wager, etc if the player fails to win anything under the rules of the individual game to which the invention is applied. The description of the preferred embodiment describes a game with only one player (other than the House) but it is neither preferred nor required that this be the case. It is required, if more than one player participates, that it be predetermined whether players are playing against other players as well as the House, or whether all players are playing against the House only, and provisions be made for determining the outcome in either event. If the House is allowed more than one hand, it is required that the result of the player beating any given number of the House's hands be determined in advance. It is preferred that the player receive the value of the player's hand multiplied by the number of the House's hands which they beat. It is preferred that the player be given the opportunity to choose the number of House hands which they will be ranked against, and that increasing the number of House hands increases the player's wager proportionately. For instance, if the player's ante or participation wager is ten cents, the player might be allowed to wager a hundred cents (one dollar) in exchange for being ranked against ten House hands.

It should also be noted that although the description of the preferred embodiment refers to the single hand which is evaluated against the others as the player's hand and the others as the House hands, it is obvious that the same game using what are otherwise the same rules could be played where the multiple hands dealt are referred to as the player's hands and the single comparison hand is referred to as the House's hand. Instead of the player wagering on the comparison of the player's hand against multiple House hands, the player wagers that one or more of the multiple player's hands will be superior to a single House hand. Mathematically and logically this is the same method, with only the labels being reversed, and the minimum threshold part of the winning requirement being applied to the player's multiple hands instead of a single player hand. For purposes of the claimed invention, a method or machine involving a single House hand and multiple player hands is equivalent to a method or machine involving a single player hand and multiple House hands.

By referring to FIG. 1, the basic concept of the invention may easily be understood. The dealer, who may be a human or a mechanical device such as the claimed gaming machine, has dealt three hands of two cards each, which are Player's Hand 10, First House Hand 12, Second House Hand 14, and the Board, the Board consisting of Flop Cards 17, a group of three cards, River Card 18, a single card, and Turn Card 19, a single card. This configuration is in accord with the laws of poker as generally understood and in particular the common variant known as "Hold 'Em." It is preferred, but not required, that First House Hand 12, Second House Hand 14, and the Board be dealt facedown if they are all dealt at the same time. If they are not dealt facedown, it will reduce, as will be obvious from later description, the number of betting opportunities. It is required that if no cards are dealt facedown, the player be required to make whatever wager or ante is allowed and appropriate before the cards are dealt. For purposes of this application, it should be understood that in FIG. 1 and all subsequent features, that if a card is depicted with a broken outline, it is to be considered facedown and its value not known to the player, and if it is depicted with a solid outline, it is to be considered faceup and its value known to the player. If the invention is being practiced as part of a gaming machine, the cards as shown in FIG. 1 would be portrayed on a display, such as a CRT, LED, or LCD based computer monitor.

Additionally, if the invention is being practiced as part of a gaming machine, that gaming machine would incorporate a computer unit with a processor, a main memory which contains dynamic information processed by the processor during operation, and a static memory which contains the fixed information, such as an operating system, game programs, and configuration information, necessary for the processor to consistently process input from the player through a control array (the control array being a keyboard, a touch-screen, or any other desired combination of controls able to accept input from a player) and produce output to the display in response to a player's input. While there are any number of potential means for evaluating the outcome of a game, in general, the computer unit would contain, within its static memory, either an algorithm for examining a particular outcome against a fixed set of rules to determine whether it is a winning outcome, or a list of all possible winning outcomes against which the particular outcome of a game can be compared. The computer unit would determine the outcome of a particular game using the rules stored in the static memory, and recognize the outcome as a particular individual outcome. As is typical in the art, it would start from some first configuration, typically the configuration produced by the particular individual outcome of the prior game, randomly reorganize the game elements, and display the reorganized game elements as a second configuration which would be the particular individual outcome of the current game.

If multiple human players are playing, or the House also has the ability to wager or fold, Player's Hand 10 should also be dealt facedown so that only the player is aware of what cards they hold. If only one player is playing against multiple fixed hands (such as First House Hand 12 and Second House Hand 14,) it is not important whether Player Hand 10 is dealt faceup or in such a way that only the one player knows what the value of the cards are. If multiple players are playing, it is required that none of them know what the values of the other players' cards are until the final ranking step. It is always required for a player to know (or at least have the opportunity to learn) what their own cards are as soon as they are dealt or at least by the time they are required to make a wager related to the value of their hands (as opposed to an ante or participation wager, which can be collected first.) The cards of the Board and of fixed hands may be dealt all at once or in any desired sequence: the description herein will assume that they are all dealt at once. If the cards are not all dealt at once, they may be dealt faceup so long as they are not dealt until it is appropriate for the player(s) and/or the House to know what their values are.

After the cards are dealt as shown in FIG. 1, the player may either choose to make a wager based on his appraisal of the value of his cards, or to "fold," or enter no wager. If the player folds, the game is over, and the House keeps the initial wager or ante. It is preferred, but not required, that every time a new amount of information regarding the potential outcome of the game becomes available, that the player be required to enter an additional wager. This is true at every subsequent step of the game as described herein, each of which is represented by a subsequent Figure. It will be assumed for the rest of the description that at every step the player enters a wager or otherwise indicates that they wish to continue.

Figure 2:
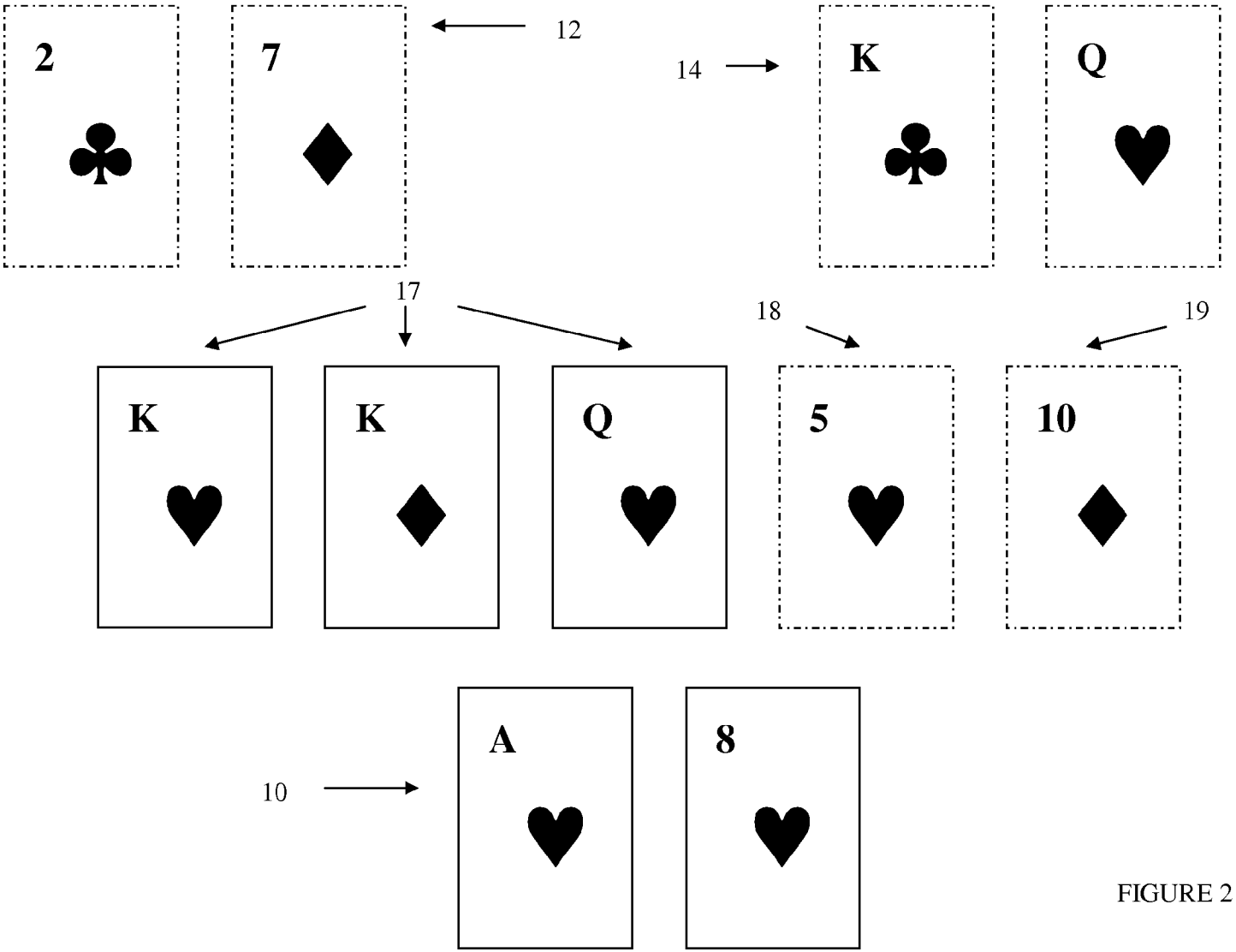
FIG. 2 is a first intermediate configuration of standard playing cards dealt into multiple hands of the poker variation known as Hold 'Em.

FIG. 2 shows the layout of the game after Flop Cards 17 of the Board, in accord with the rules of Hold 'Em, have been dealt and/or put faceup. The player now knows that they have a pair of kings showing on the Board, and that furthermore they have a potential flush as their cards are of a suit and two other cards in that suit are on the Board. The player is assumed to make a wager and continue.

Figure 3:
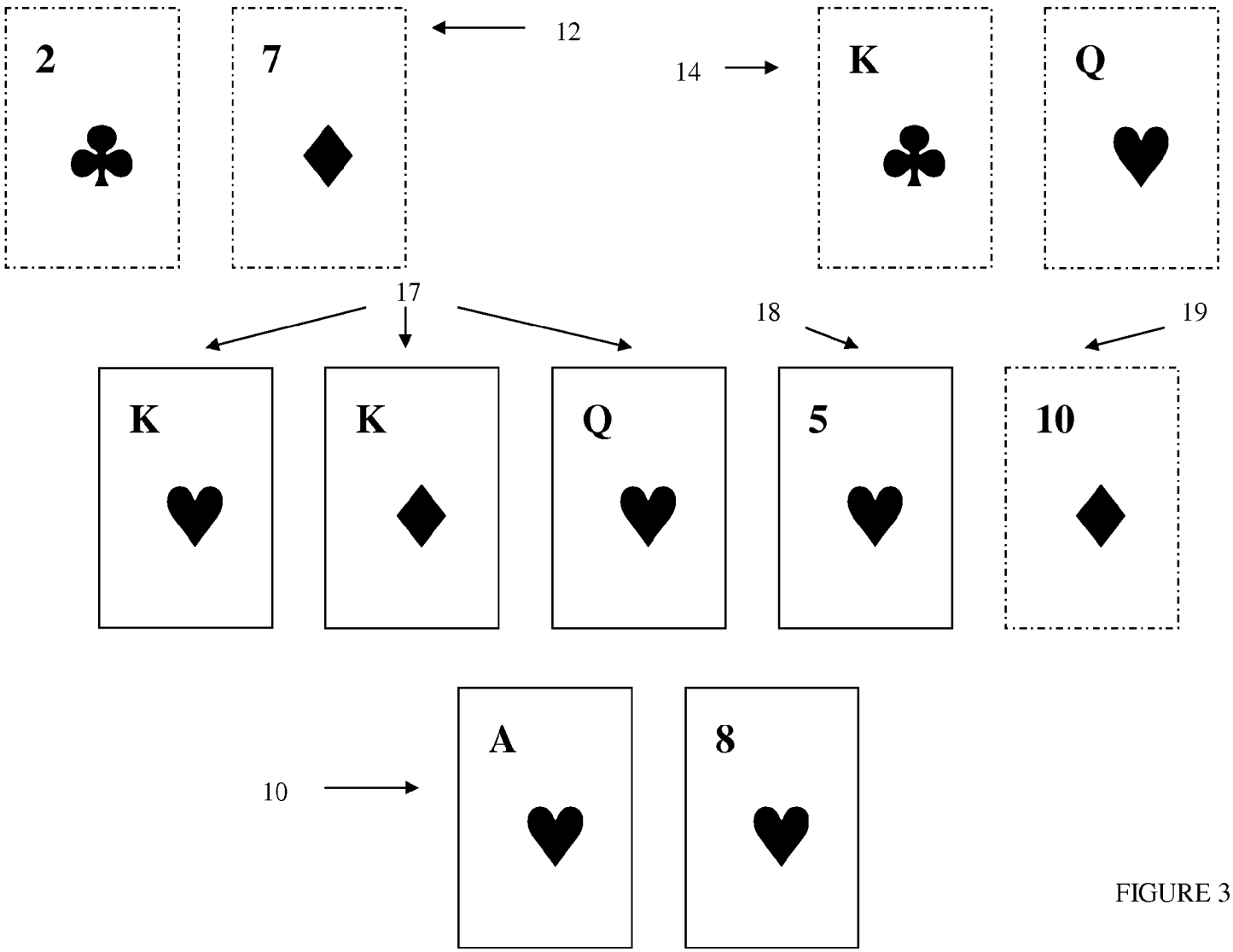
FIG. 3 is a second intermediate configuration of standard playing cards dealt into multiple hands of the poker variation known as Hold 'Em.

FIG. 3 shows the layout of the game after Turn Card 18 of the Board, in accord with the rules of Hold 'Em, has been dealt and/or put faceup. The player now knows that they have a pair of kings showing on the Board, and that furthermore they have an Ace-high flush as their cards are of a suit and three other cards in that suit are on the Board. The player is assumed to make a wager and continue.

Figure 4:
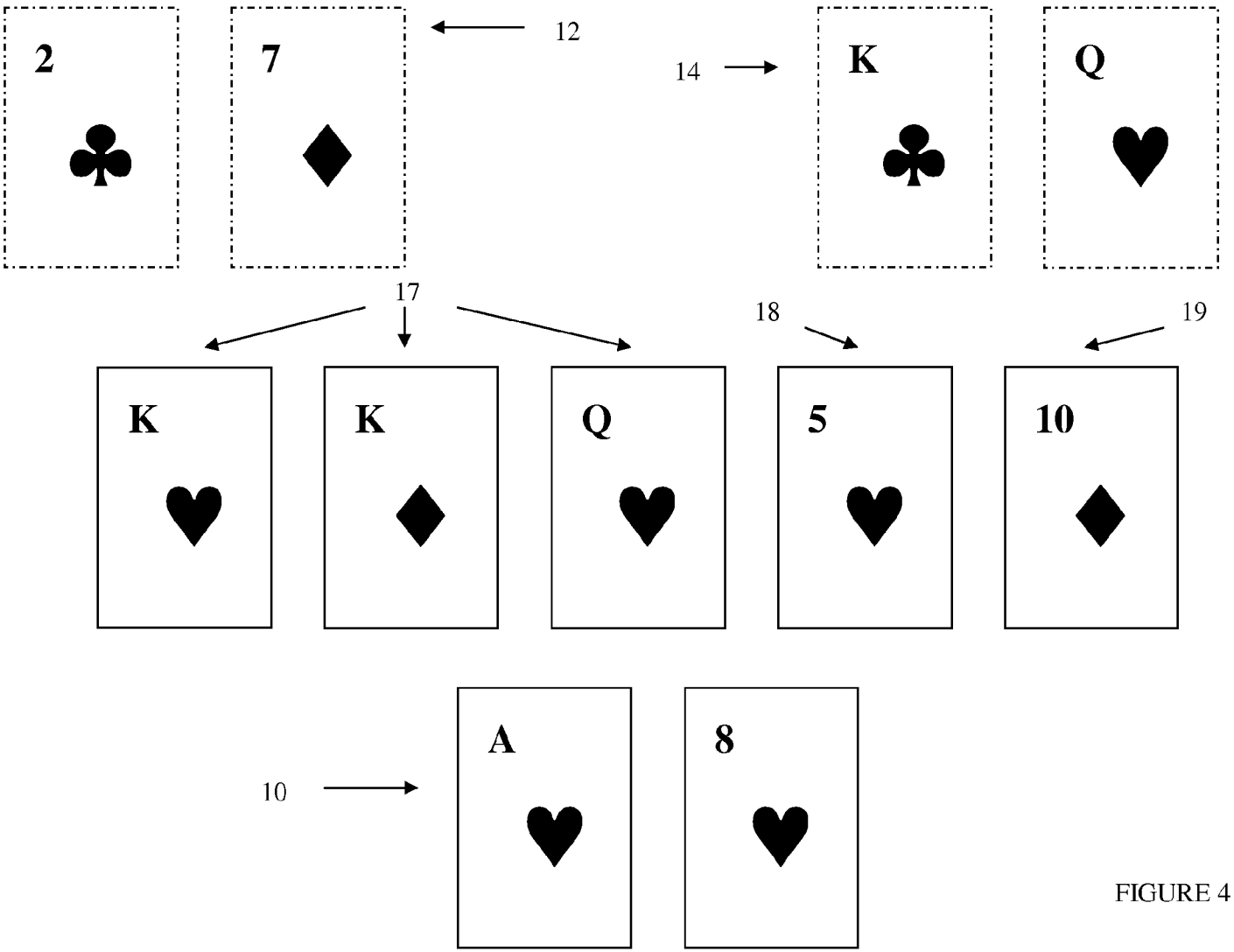
FIG. 4 is a third intermediate configuration of standard playing cards dealt into multiple hands of the poker variation known as Hold 'Em.

FIG. 4 shows the layout of the game after River Card 18 of the Board, in accord with the rules of Hold 'Em, has been dealt and/or put faceup. The player now knows that they have a pair of kings showing on the Board, and that furthermore they have a flush as their cards are of a suit and three other cards in that suit are on the Board. The player also knows that it is possible for other players to have a straight, but not a flush of any other suit, a straight flush, or a flush of a higher value than theirs since they have the Ace of the suit. The player is assumed to make a wager and continue.

Figure 5:
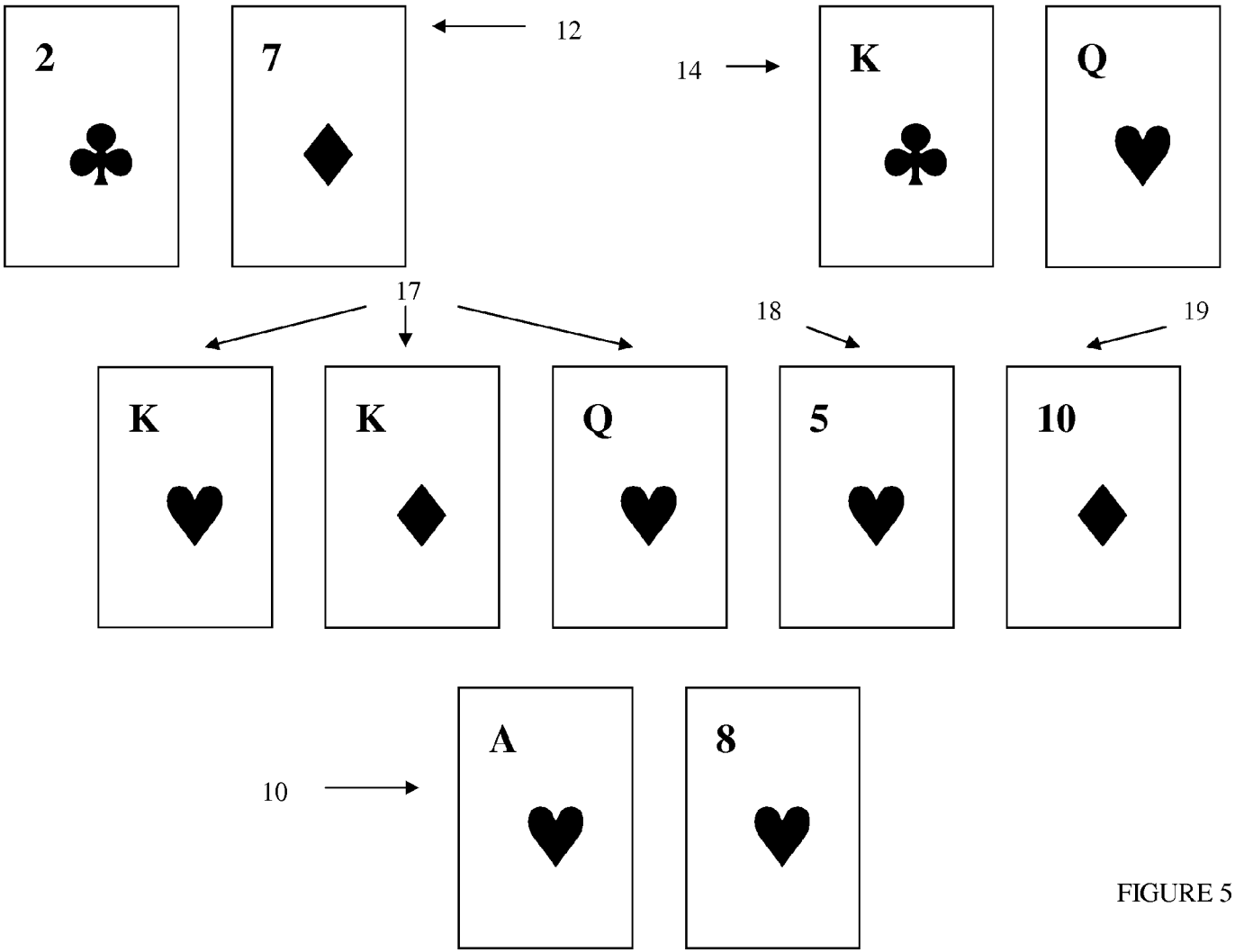
FIG. 5 is a final configuration of standard playing cards dealt into multiple hands of the poker variation known as Hold 'Em.

FIG. 5 shows the layout of the game after the House Hands have been dealt and/or put faceup. Under the laws of poker, the player's best hand is an Ace-high flush (A-K-Q-8-5.) The player has beaten First House Hand 12, as its best hand is a pair of kings (K-K-Q-10-7.) The player has not beaten Second House Hand 14, as its best hand is a Full House (K-K-K-Q-Q.) Under the rules of the game incorporating the invention's requirement of a minimum threshold, the player has qualified to win, as their best hand would beat a pair of Jacks. Under the rules of the game incorporating the invention's requirement of having a superior ranking to one or more House Hands, the player has succeeded in beating one House Hand but not two. Therefore, the player is paid the corresponding value of a flush from the fixed pay table. Had the player beaten both House Hands, they would have received twice the value of a flush from the fixed pay table. Had the player not beaten either House Hand, they would have received nothing even though they met the requirement for the minimum threshold. Had the player beaten both House Hands but not held Jacks or better, the pre-established minimum, they would have received nothing even though they beat one or more House Hands.

While the description above details the preferred and best mode(s) of practicing the invention, many other configurations and variations are possible. For example, the invention need not be practiced with a commercial gaming unit, but could used with a variety of coin-operated amusement devices, home gaming systems, or any other appropriate system. Accordingly, the scope of the invention should be determined not by the embodiment(s) illustrated, but by the claims below and their equivalents.

What is claimed is:

1. A method for playing a gambling game having multiple winning thresholds, comprising the steps of:

providing a gaming machine for playing the gambling game;

selecting a set of evaluation objects which can be grouped into a plurality of rankable subsets;

setting forth a system for ranking the plurality of rankable subsets;

selecting a minimum threshold for a minimum winning rankable subset;

distributing at least one player hand to at least one player, the player hand comprising a first subset of evaluation objects chosen from the set of evaluation objects;

distributing at least one house hand, the house hand comprising a second subset of evaluation objects chosen from the set of evaluation objects;

accepting an initial wager from a player;

distributing a community hand, the community hand comprising a third subset of evaluation objects chosen from the set of evaluation objects;

presenting the at least one player hand, the at least one house hand and the community hand on a display of the gaming machine;

evaluating the first subset of evaluation objects of the player hand and the second subset of evaluation objects of the house hand individually with the third subset of evaluation objects of the community hand to individually form a final player hand and a final house hand, the final player hand being a combined subset of evaluation objects selected from the first and third subsets of evaluation objects that has a highest possible ranking according to the system, the final house hand being a combined subset of evaluation objects selected from the second and third subsets of evaluation objects that has a highest possible ranking according to the system;

providing an opportunity for accepting at least one additional wager from the player before the final player hand and final house hand are presented to the player;

comparing the final player hand to the minimum winning rankable subset and determining whether the final player hand has a ranking that is equal to or in excess of the minimum threshold for a winning rankable subset, and if the ranking of the final player hand is equal to or in excess of the threshold for a minimum winning rankable subset, continuing play, otherwise collecting all wagers placed on the final player hand; and where the final player hand is equal to or in excess of the threshold for a minimum rankable subset, comparing the final player hand to the final house hand and determining whether the final player hand ranking is equal to or in excess of the final house hand ranking, where the final player hand ranking is equal to or in excess of the final house hand ranking, awarding a prize to the player, otherwise collecting all wagers placed on the final player hand.

2. A method for playing a gambling game having multiple winning thresholds as in claim 1, wherein a plurality of house hands are dealt, and after determining that the final player hand ranking is equal to or in excess of the minimum winning rankable outcome, if the final player hand ranking is equal to or in excess of an individual final house hand ranking, awarding the player a prize for each of the individual final house hand rankings where this is the case.

3. A method for playing a gambling game having multiple winning thresholds as in claim 1, wherein two or more house hands are dealt, and after determining that the final player hand ranking is equal to or in excess of the minimum winning rankable outcome, if the final player hand ranking is equal to or in excess of an individual final house hand ranking, awarding the player a prize for each of the individual final house hand rankings where this is the case.

4. A method for playing a gambling game having multiple winning thresholds as in claim 3, wherein the prize awarded for a final player hand ranking equal to or in excess of an individual final house hand ranking has a fixed value, and the player is awarded a final prize equal to the fixed value times the number of individual final house hands for which the final player hand ranking is equal to or in excess of that individual final house hand ranking.

5. The method of claim 1, where in presenting the at least one player hand, the at least one house hand and the community hand, a value of the individual evaluation objects of the at least one house hand and the community hand are concealed on the display.

6. The method of claim 5, wherein during play of the game, the value of some of the individual evaluation objects of the community hand are revealed on the display while the value of the remaining evaluation objects are concealed, the value of individual evaluation objects of the community hand being revealed in stages and providing the at least one opportunity for accepting the additional wager from at least one player after each stage.

7. A gaming machine for playing a gambling game having multiple winning thresholds, comprising:

a gaming machine having a processor unit, a static memory, a main memory, a random number generator, a set of controls, and a display, where a player can play a gambling game on the gaming machine utilizing the set of controls and viewing the gambling game and an outcome of the gambling game on the display, the play of the gambling game being controlled by the processor in accord with instructions stored in the static memory and the gambling game being displayed on the display during play of the gambling game; and a program for playing a gambling game with multiple winning thresholds, the program being stored in the static memory, where by executing the program, the processor accepts an initial wager from a player and instructs the random number generator to select from a set of evaluation objects at least one player hand comprising a first subset of evaluation objects, at least one house hand comprising a second subset of evaluation objects and a community hand comprising a third subset of evaluation objects, the processor evaluates the first subset of evaluation objects of the player hand and the second subset of evaluation objects of the house hand individually with the third subset of evaluation objects of the community hand to form a final player hand and a final house hand, the final player hand being a combined subset of evaluation objects selected from the first and third subsets of evaluation objects that has a highest possible ranking according to the instructions, the final house hand being a combined subset of evaluation objects selected from the second and third subsets of evaluation objects that has a highest possible ranking according to the instructions, the processor provides an opportunity for accepting at least one additional wager from the player before the final player hand and final house hand are presented to the player and compares the final player hand to a minimum winning rankable subset and determines whether the final player hand has a ranking that is equal to or in excess of the minimum threshold for a winning rankable subset:

if the ranking of the final player hand is not equal to or in excess of the threshold for a minimum winning rankable subset, the processor instructs the machine to collect all wagers placed on the final player hand, if the ranking of the final player hand is equal to or in excess of the threshold for a minimum winning rankable subset, the processor evaluates the final player hand against the final house hand; and where the final house hand ranking is equal to or in excess of the final player hand ranking, the processor instructs the machine to collect all wagers placed on the final player hand, if the final player hand ranking is equal to or in excess of the final house hand ranking, the processor instructs the machine to award a prize to the player.

8. A gaming machine for playing a gambling game having multiple winning thresholds as in claim 7, wherein the program instructs the processor to deal a plurality of house hands, and the program further instructs the processor to determine for each of the plurality of final house hands whether the final player hand ranking is equal to or in excess of the minimum winning rankable outcome, and if so then if the final player hand ranking is also equal to or in excess of an individual final house hand ranking, awarding the player a prize for each of the individual final house hand rankings where this is the case.

9. A gaming machine for playing a gambling game having multiple winning thresholds as in claim 7, wherein the program instructs the processor to deal at least two individual house hands, and the program further instructs the processor to determine for each of the individual final house hands whether the final player hand ranking is equal to or in excess of the minimum winning rankable outcome, and if so then if the final player hand ranking is also equal to or in excess of an individual final house hand ranking, awarding the player a prize for each of the individual final house hand rankings where this is the case.

10. A gaming machine for playing a gambling game having multiple winning thresholds as in claim 9, wherein the program assigns a fixed value to the prize awarded for a final player hand ranking equal to or in excess of an individual final house hand ranking, and the program directs the processor to award the player a final prize equal to the fixed value times the number of individual final house hands for which the final player hand ranking is equal to or in excess of that individual final house hand ranking.

11. The gaming machine of claim 7, where each of the individual evaluation objects of the at least one house hand and the community hand have a value that are concealed on the display.

12. The gaming machine of claim 11, wherein during play of the game, the value of some of the individual evaluation objects of the community hand are revealed on the display while the value of the remaining evaluation objects are concealed from the at least one player, the value of individual evaluation objects of the community hand being revealed in stages and providing opportunities for accepting additional wagers from at least one player after each stage.

* * * * *